US006786555B2

(12) United States Patent
Brook

(10) Patent No.: US 6,786,555 B2
(45) Date of Patent: Sep. 7, 2004

(54) CONVERTIBLE INFLATABLE FURNISHING

(76) Inventor: Sapoty Brook, P.O. Box 352, Mullumbimby, NSW (AU), 2482

( * ) Notice: Subject to any disclaimer, the term of this patent is extended or adjusted under 35 U.S.C. 154(b) by 0 days.

(21) Appl. No.: 09/836,677

(22) Filed: Apr. 17, 2001

(65) Prior Publication Data

US 2002/0043869 A1 Apr. 18, 2002

(30) Foreign Application Priority Data

Apr. 18, 2000 (AU) ..... PQ6944

(51) Int. Cl.[7] ..... A47C 7/02

(52) U.S. Cl. ..... 297/452.41; 297/DIG. 3; 297/272.3; 297/286.6; 5/710; 5/655.3

(58) Field of Search ..... 297/452.41, DIG. 3, 297/272.3, 16.2; 5/710, 655.3, 654, 712

(56) References Cited

U.S. PATENT DOCUMENTS 1,976,320 A * 10/1934 Austin ..... 297/62
2,623,574 A * 12/1952 Damsch ..... 297/111
5,292,176 A * 3/1994 Artz ..... 297/250.1
5,560,056 A * 10/1996 Tai ..... 297/118
5,608,931 A * 3/1997 Gancy ..... 5/711
5,868,463 A * 2/1999 MacKenzie et al. ... 297/228.12
6,012,778 A * 1/2000 Peterson ..... 297/452.41
6,042,186 A * 3/2000 Kojic et al. ..... 297/452.41
6,152,530 A * 11/2000 Hsu et al. ..... 297/272.3
6,161,902 A * 12/2000 Lieberman ..... 297/452.41
6,382,729 B1 * 5/2002 Wu ..... 297/16.2

* cited by examiner

*Primary Examiner*—Peter M. Cuomo
*Assistant Examiner*—Erika Garrett

(57) ABSTRACT

A convertible inflatable furnishing is disclosed. The furnishing can form a chair shape that can be converted into a supportive shape for massage and stretching by deflating and securing the backrest inside the furnishing. The chair is also capable of being rocked, reclined, and packed into itself.

5 Claims, 3 Drawing Sheets

CONVERTIBLE INFLATABLE FURNISHING

BACKGROUND OF THE INVENTION

This invention relates to improvements in inflatable furniture.

Beanbag chairs have been popular for many years as a low cost furnishing. However the plastic beans get squashed and a beanbag needs refilling with plastic beans every few months. Inflatable chairs have recently become more popular. Both of the above types of chairs are not capable of being easily rocked or reclined. In addition, there is increasing interest in healthy activities such as massage and stretching. Massage tables can be relatively expensive, take up significant indoor space, and are not usually convertible into a chair. Folding massage tables are heavy and not easy to fold, carry or travel with.

BRIEF SUMMARY OF THE INVENTION

These problems are overcome by the present invention, which provides a convertible inflatable furnishing which comprises an inflatable base, an inflatable backrest, a fixing means to fix the backrest to the base, and an air passage between the base and the backrest allowing a flow of air between the base and the backrest when loads on the base and backrest change.

The preferred embodiment allows the backrest to be easily reclined by an occupant leaning back on it and reducing their weight on the base. The fixing means is sufficiently flexible to allow the backrest to recline increasingly with deflation of the backrest when the backrest is under an increasing load. Also the occupant can easily rock on the chair to an extent constrained by a connecting means provided to connect a region of the base upper skin to a region of the base lower skin with the connecting means being in tension when the base is substantially inflated.

The preferred embodiment can easily be converted into an excellent massage support structure which is relatively inexpensive. A retaining means is provided which can be operated to retain the backrest inside the base in a substantially deflated state so that it does not obstruct the massage. The outer shape of the base has a horizontal breadth of between 700 mm and 1000 mm enabling the base, when rotated onto a rim side, to support the torso of a person at a height where massage and other body manipulation and stretching are facilitated.

The preferred embodiment can be packed into its own backrest for portability. A fastening means is provided to retain the deflated base inside the deflated backrest.

A purpose of the convertible furnishing described herein is to provide a comfortable, rockable, reclinable, light, aesthetic, affordable, and environmentally-friendly armchair. The provision of a strong fabric outer cover enables the use of an environmentally-friendly, lightweight bladder constructed from non-PVC plastic.

A purpose of the convertible furnishing described herein is to provide a massage support structure. The curved structure stretches the torso enabling deep massage and simultaneously stretching muscles and connective tissue similarly to yogic practices.

The convex lying surface allows nurturing postures similar to those experienced in infancy on the mother's body. The injectable inflated structure allows a greater degree of displacement or pulsation to be introduced into the massage than is possible on standard massage tables.

In the prostrate position the head may hang with the chin resting gently. This allows the face to be easily included in the massage.

The convertible furnishing described herein can be used for massage, stretching, relaxation, sitting, floatation, and children's and adult's recreation.

DETAILED DESCRIPTION OF THE INVENTION

Figure 1:
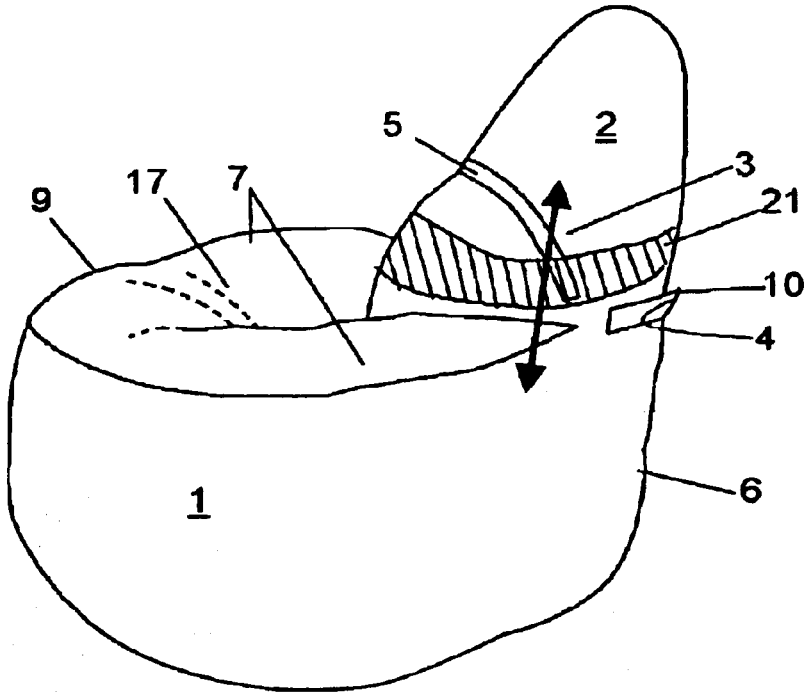
FIG. 1 shows an elevation view of an embodiment of the convertible furnishing with a backrest erect.
Figure 2:
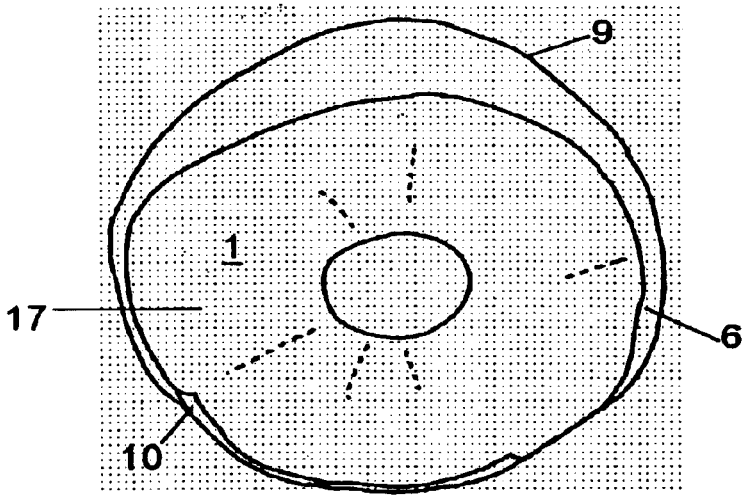
FIG. 2 shows an elevation view of an embodiment of the convertible furnishing placed on its rim side with the backrest unerect and enclosed in the base.
Figure 3:
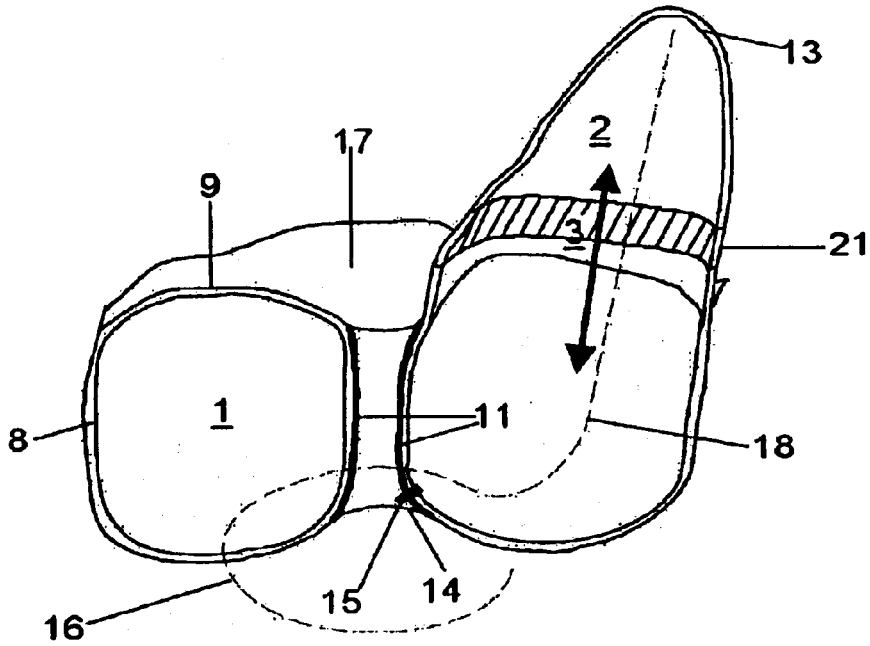
FIG. 3 shows a combined elevation and cross-sectional view of an embodiment of the convertible furnishing with backrest erect and the internal spatial arrangement of the bladder indicated.

An embodiment of the convertible inflatable furnishing as shown in FIG. 1 for sitting and other uses comprises an inflatable base 1 including a base upper skin 17 which forms a layer of the upper side of the base 1 and a base lower skin 16 shown in FIG. 3 which forms a layer of the lower side of the base 1, and a rim side 6 which links the edge of the upper side of the base to the edge of the lower side of the base, an inflatable backrest 2 providing back support for a person sitting on the base 1, a fixing means 21 to fix the backrest to the base upper skin 17, and an air passage 3 between the base 1 and the backrest 2 allowing a flow of air between the inside of the base 1 and the inside of the backrest 2 when loads on the base and backrest change, and a first part of retaining means 4 and a second part of retaining means 5 wherein the air in the backrest can be squeezed out of the backrest through the air passage 3 into the base 1 and a first part of retaining means 4 and a second part of retaining means 5 can be fastened together to retain the backrest 2 in a substantially unerect state shown in FIG. 2 enabling use of the base 1 for various purposes including body therapies in situations where a protruding backrest 2 is an obstruction.

The base upper skin 17 and the base lower skin 16 are layers of the base 1 which participate in holding the tension created by pressure when a load is on the furnishing. The base upper skin 17 and the base lower skin 16 may be gas impermeable layers or other layers.

The fixing means 21 (hatched in FIG. 1) consists of a flexible closed-loop strip forming a single hole with the internal surface of the flexible closed-loop strip not substantially adhered to itself at any place to form a hinge (shown In FIG. 7), an upper edge of the flexible closed-loop strip permanently connected to a lower end of the backrest 2 and a lower edge of the flexible closed-loop strip permanently connected to the base upper skin 17. In the present embodiment the air passage 3 is provided by the entirely open hole through the fixing means 21. The location of the reversible flow of air through the air passage 3 is indicated by the double-headed arrow that is intended to indicate a flow of air inside the convertible furnishing (shown more clearly in FIG. 7).

In this embodiment shown in FIG. 1 a cover 9 is provided on which the first part of retaining means 5 and a flap 10 are mounted. The second part of retaining means 4 is mounted on the side of the flap 10 which is facing the cover 9 and is hidden from view by the flap 10. Incidental creases in the cover 9 are shown with dotted lines in FIG. 1 and FIG. 2.

FIG. 2 shows the embodiment of the convertible furnishing tilted on the rim side 6 with the backrest 2 deflated and inserted into the base 1 and the first part of retaining means 4 shown in FIG. 1 and the second part of retaining means 5 shown in FIG. 1 fastened together to retain the backrest 2 in a substantially deflated state inside the base 1 and hidden from view.

In this embodiment the first part of retaining means 4 is hook strip and the second part of retaining means 5 is loop strip and these strips can be fastened together by the well-known press-seal method (e.g. Velcro). In this case the backrest is retained substantially inside the base 1. When this method of retaining the backrest is used it is preferable that the hook strip is mounted on the side of the flap 10 that is facing the cover 9 as indicated, but hidden from view, in FIG. 1. Then when a load is applied to the furnishing with the press-seal engaged as shown in FIG. 2 the resulting force on the strips is substantially tangential to the surface of the strips and does not tend to separate the strips.

FIG. 3 is a combined elevation and cross-sectional view showing the interior of the embodiment revealing that the base 1 and the backrest 2 share a single bladder 8, the fabric cover 9 covers the entire bladder 8, and the base lower skin 16 and the base upper skin 17 are parts of the cover 9. The bladder 8 is of a size and shape that when inflated fills the cover 9 so that the shape of the cover 9 substantially determines the shape of the furnishing. As shown in FIG. 3 a zip 14 is provided on the base lower skin 16 for internal access and a nozzle 15 is fixed to the connecting means 11 provided near and accessible through the zip 14 for inflating and deflating the bladder 8.

In this embodiment the bladder 8 is substantially tubular with sealed ends, and the axis of the tubular bladder 8 is curved around the connecting means 11 and the bladder 8 is sufficiently long that a region of the bladder 8 in the vicinity of one sealed end of the bladder 8 abuts a region of the bladder 8 in the vicinity of the other sealed end of the bladder 8. The tubular bladder 8 follows a curved path 18 around the axis defined by the connecting means 11. The curved dashed line shown in FIGS. 3 and 4 indicates this curved path 18.

A first bladder end 13 is part of one end of the bladder 8 and protrudes upward into the backrest 2 according to the curved path 18 when the backrest 2 is erect. The first bladder end 13 may be shaped similarly to the backrest 2 but is preferably slightly larger than the backrest 2 so that the bladder 8 fully erects and fills the backrest 2 when the retaining means 4 is released and a load is applied to the base 1.

Figure 4:
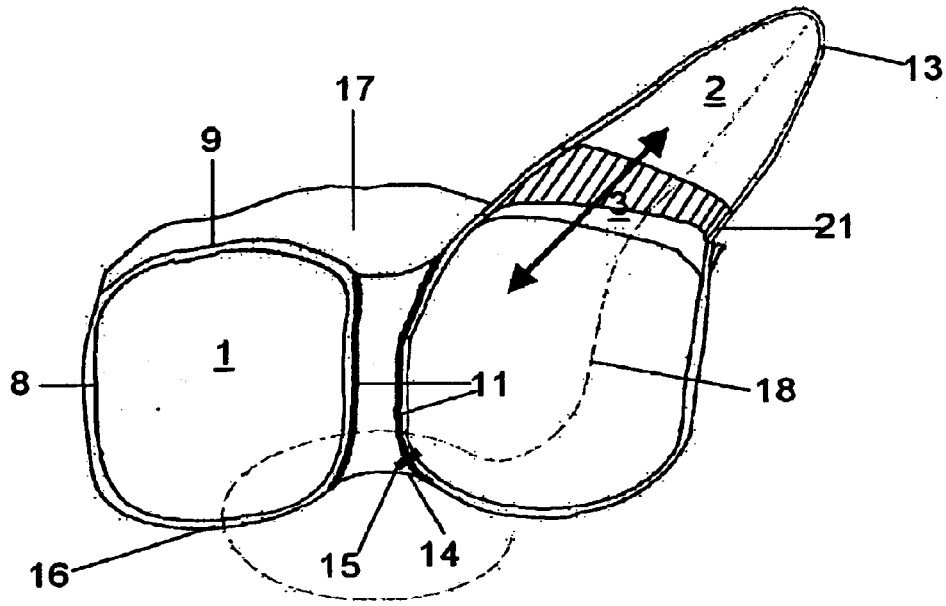
FIG. 4 shows a combined elevation and cross-sectional view of an embodiment of the convertible furnishing with backrest reclined with the internal spatial arrangement of the bladder indicated.

In this embodiment a connecting means 11 shown in cross-section in FIGS. 3 and 4 is provided to connect a region of the base upper skin 17 to a region of the base lower skin 16 with the connecting means 11 being in tension when the base 1 is substantially inflated. In this embodiment the said regions are near the center of the base upper skin 17 and the center of the base lower skin 16. The connecting means 11 is an elasticized fabric formed into a cylindrical shape with the ends of the cylinder sewn with circular seams onto the base lower skin 16 and the base upper skin 17. The length of the cylinder is sufficiently short to substantially constrain horizontal mobility of the base upper skin 17 relative to the base lower skin 16 when the base lower skin 16 is placed on a floor thereby providing a more stable, comfortable seat. The connecting means 11 is preferably of sufficient length to allow an occupant of the seat to make small rocking movements while sifting on the base upper skin 17. The connecting means 11 preferably has such a length as to constrain horizontal mobility of the base upper skin within 20 cm of the equilibrium position when a horizontal component of force of 100N is applied to the base upper skin. The connecting means 11 is preferably an elastic material of sufficient tensile strength and elasticity to absorb pressure shocks resulting from sudden loads applied to the furnishing, such as 100 kg failing one meter onto the furnishing.

It will be realized that the connecting means 11 according to the present invention is not restricted to the fabric construction described above, but may use cord, strap, fabric or film with any combination of materials of sufficient strength including inelastic materials. The fastening system for fastening the connecting means 11 to the base lower skin 16 and the base upper skin 17 is not restricted to sewing, but may use any fastening system with sufficient tensile strength and purchase, including bonding and bolting systems.

In the embodiment shown in combined elevation and cross-section in FIG. 3 and FIG. 4 the air passage 3 is provided by providing the base 1 and the backrest 2 with a single shared bladder 8 allowing the air to flow back and forth between the backrest 2 and the base 1 through the region of the bladder 8 where the backrest 2 joins the base 1. The location of the reversible flow of air through the air passage 3 is indicated by the double headed arrow (shown more clearly in FIG. 7).

The embodiment shown in combined elevation and cross-section in FIG. 3 and FIG. 4 allows the backrest 2 to be easily reclined by an occupant leaning back on the backrest 2 and reducing their weight on the base 1. The fixing means 21 (hatched in FIGS. 3 and 4) is sufficiently flexible to allow the backrest 2 to recline increasingly with deflation of the backrest 2 including when the backrest 2 is under an increasing load, and to allow the backrest 2 to erect increasingly with inflation of the backrest 2 including when the load on the backrest 2 is reducing. In this embodiment the fixing means 21 is a flexible region of the fabric cover 9 where the backrest 2 joins to the base 1. The fabric provides flexibility by folding and bending and contracting at the rear side of the fixing means 21 and bending and stretching at the front side of the fixing means 21 as shown in FIG. 4.

In the embodiment shown in FIG. 4, the connecting means 11 includes an elastic material biasing the region of the base upper skin 17 towards the region of the base lower skin 16. The elastic material in tension preferably provides a elastic modulus capable of supporting an increased load on the backrest 2 wherein the supporting force tending to maintain erection of the backrest 2 is increased when the base 1 volumetrically expands due to increased pressurization of the base 1 resulting from increased compression of the backrest 2. In this manner the erection of the backrest 2 is assisted by the tension in the connecting means 11 and a person reclining on the convertible furnishing experiences increased back support at all angles of recline.

It will be realized that the convertible furnishing according to this invention is not restricted to an embodiment having a fabric cover 9, but may use an uncovered single bladder or plural bladders with no cover or partial covers.

Figure 5:
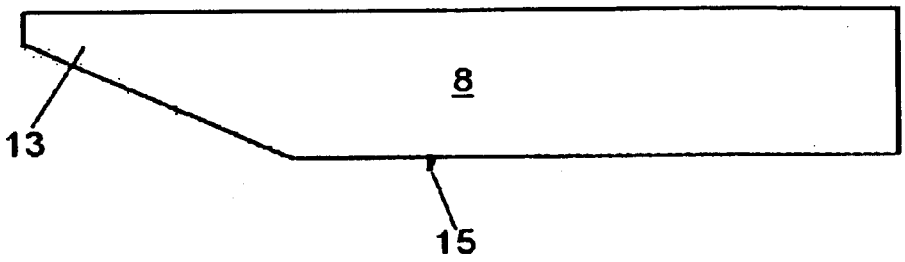
FIG. 5 shows a view of a bladder laid flat.

FIG. 5 shows an embodiment of the bladder 8 as a laid flat tube. A nozzle 15 for inflation and deflation of the bladder 8 is positioned near the first bladder end 13. The nozzle 15 is preferably fixed to the cover 9 or to the connecting means 11 in the position shown in FIG. 3 to assist in locating the first bladder end 13 in the backrest 2. It will be realized that the nozzle 15 may be fixed in other locations in the region of the backrest 2 in order to locate the first bladder end 13 relative to the backrest 2. The preferred material of the bladder is a plastic film such as polyurethane, polyethylene or PVC. The film may be admixed, laminated, or metalized to reduce gas permeability.

Figure 6:
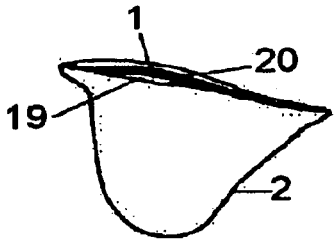
FIG. 6 shows a view of an embodiment of the convertible furnishing in a deflated state packed into its own backrest.

In the embodiment shown in FIG. 6 the base 1 when deflated and backrest 2 when deflated have relative volumes allowing the base 1 to be fully inserted into the backrest 2 and a first part of fastening means 19 and a second part of fastening means 20 are provided to retain the deflated base 1 inside the deflated backrest 2. In this embodiment the first part of fastening means 19 is also the first part of retaining means 4 and the second part of fastening means 20 is also the second part of retaining means 5. When the base 1 has been inserted into the backrest 2, the flap 10 can be folded open so that the first part of fastening means 19, which is hook strip, faces and can be press-seal fastened onto the second part of fastening means 20, which is loop strip, to retain the base 1 inside the backrest 2 for the purposes of packing and portability. Other fasteners such as a zip or studs could provide this fastening.

Figure 7:
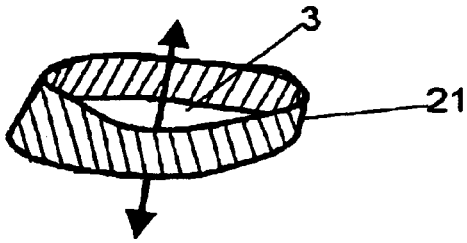
FIG. 7 shows an elevation view of an embodiment of the fixing means as a disconnected portion of the convertible furnishing.

FIG. 7 shows an elevation view of an embodiment of the fixing means 21 as a disconnected portion of the convertible furnishing shown in FIG. 1. The fixing means 21 consists of a flexible closed-loop strip forming a single hole with the internal surface of the flexible closed-loop strip not substantially adhered to itself at any place to form a hinge. The location of the reversible flow of air through the air passage 3 is indicated by the double headed arrow. The fixing means 21 may be the only connection between the base 1 and the backrest 2.

Figure 8:
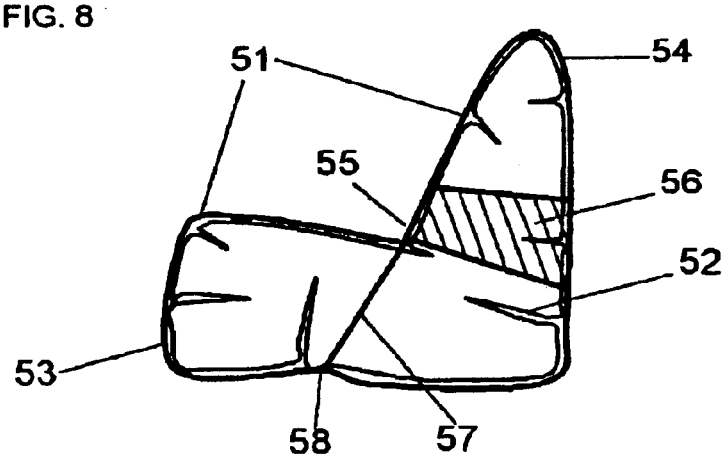
FIG. 8 shows a cross-sectional view of another embodiment of the convertible furnishing with the backrest erect.

A cross-sectional view of another embodiment of the convertible furnishing with the backrest erect is shown in FIG. 8 and comprises a gas-permeable cover 51 fully enclosing a flexible bladder 52, wherein the gas-permeable cover 51 is shaped to farm a seat with a base 53 and a backrest 54 and the flexible bladder 52 is not shaped similarly to the gas-permeable cover when it is inflated outside the gas-permeable cover. In one embodiment the flexible bladder 52 is shaped as a laid flat tube as shown in FIG. 5 as bladder 8 and described previously.

In the embodiment shown in FIG. 8 a connecting means 57 is provided inside the gas-permeable cover 51 connecting a lower portion of the backrest front side 55 portion of the gas-permeable cover 51 to the base lower side 58 portion of the gas-permeable cover 51 arid preferably but not necessarily attaching to the base lower side 58 more forward than the attachment of the connecting means to the lower portion of the backrest front side 55, and the flexible bladder 52 when inflated fills the whole gas-permeable cover 51, preferably without laterally displacing the connecting means 57. Lateral displacement of the connecting means 57 could cause unwanted lateral distortion of the gas-permeable cover 51.

In the embodiment shown in FIG. 8 the backrest front side 55 is shaped to provide a substantially smooth, unfolded, surface above the place of attachment of the connecting means 57 to the lower portion of the backrest front side 55 thereby facilitating an even and uninterrupted flow of tension up the backrest front side 55.

In the embodiment shown in FIG. 8, a region of the gas-permeable cover 51 is flexible and shaped as a loop 56 (shown hatched and assuming that the bladder 52 is transparent) encircling the backrest 54 and including a lower region of the backrest front side 55 and optionally including a rear region of the base 53 adjoining the backrest 54. The loop 56 is a region of the gas-permeable cover 51 that can bend or fold to allow the backrest 54 to recline in the same manner as fixing means 21 previously described with reference to FIGS. 3 and 4.

In the embodiment shown in FIG. 8 the flexible bladder 52 has a fully inflated volume outside the gas-permeable cover 51 at least twenty percent greater than its fully inflated volume inside the gas-permeable cover 51 with said volumes being measured at a pressure less than two kilopascals.

In the embodiment in the erect state of the backrest 2 shown in FIG. 1 the outer shape of the base 1 has a horizontal width transverse to the usual direction of sitting of about 850 mm, but preferably at least 600 mm, to enable the base upper skin 17 to puff upward beside the outer sides of a sitter's thighs thereby providing armrests 7.

In the embodiment as shown in FIG. 1 the outer shape of the base 1 has a horizontal breadth of about 850 mm enabling the base 1 to be tilted onto a rim side 6 as shown in FIG. 2 to provide support for the torso of a person at a height where massage and other body manipulation and stretching is facilitated. These activities are facilitated when a horizontal breadth of the base 1 is in the range 700 mm to 1000 mm. A small cushion may be provided for the chin-tip of a person lying prostrate along the rim side 6.

In the embodiment shown in FIG. 1 about half the air can be released so that the furnishing can be used as a seat supporting the occupant at a height and in a posture similarly to a bean bag seat.

It will be realized that the convertible furnishing according to this invention is not restricted to having a single backrest 2 positioned at or near one edge of the base upper skin 17, but may have one or more backrests positioned at any location on the base upper skin 17.

I claim:

1. A convertible inflatable furnishing which comprises an inflatable base including a base upper skin which forms a layer of the upper side of the base, a base lower skin which forms a layer of the lower side of the base, and a rim side which links the edge of the upper side of the base to the edge of the lower side of the base, an inflatable backrest, a fixing means to fix the backrest to the base upper skin, and an air passage between the base and the backrest allowing a flow of air between the inside of the base and the inside of the backrest when loads on the base and backrest change; said fixing means consists of a flexible closed-loop strip forming a single hole with the internal surface of the flexible closed-loop strip not substantially adhered to itself at any place to form a hinge, an upper edge of the flexible closed-loop strip permanently connected to a lower end of the backrest and a lower edge of the flexible closed-loop strip permanently connected to the base upper skin; said fixing means is sufficiently flexible to allow the backrest to recline increasingly with deflation of the backrest including when the backrest is under an increasing load, and allow the backrest to erect increasingly with inflation of the backrest including when the load on the backrest is reducing.

2. The convertible inflatable furnishing of claim 1 wherein a connecting means is provided completely inside the base to connect a region of the base upper skin to a region of the base lower skin with the connecting means being in tension when the base is substantially inflated and the connecting means having such a length as to constrain horizontal mobility of the base upper skin relative to the base lower skin; wherein the connecting means includes an elastic material to absorb pressure shocks by reducing the maximum tension resulting from sudden loads applied to the furnishing.

3. The convertible inflatable furnishing of claim 2 wherein the connecting means includes an elastic material biasing the region of the base upper skin towards the region of the base lower skin, wherein the connecting means is connected to the base upper skin at a location where the front side of the backrest is joined to the base upper skin allowing tension in the elastic material to transmit through the base upper skin to the front side of the backrest, the elastic material in tension having a elastic modulus capable of supporting an increased load on the backrest wherein the supporting force tending to maintain erection of the backrest is increased when the base volumetrically expands due to increased pressurization of the base resulting from increased compression of the backrest.

4. The convertible inflatable furnishing of claim 2 wherein the bladder is fully enclosed by a cover, the base lower skin and the base upper skin are parts of the cover, and the bladder is of any size and shape that when inflated fills the cover and applies tension substantially throughout the cover so that the shape of the cover substantially determines the shape of the furnishing.

5. The convertible inflatable furnishing of claim 4 wherein the inflated bladder is tubular with sealed ends and the axis of the tubular bladder is curved in a substantially planar path surrounding the connecting means and the bladder is sufficiently long that a region of the bladder in the vicinity of one sealed end of the bladder abuts a region of the bladder in the vicinity of the other sealed end of the bladder.

* * * * *